US005769351A

United States Patent [19]

Van Den Berg et al.

[11] Patent Number: 5,769,351

[45] Date of Patent: Jun. 23, 1998

[54] METHOD OF WINDING A SADDLE-SHAPED DEFLECTION COIL

[75] Inventors: Hendrik D. Van Den Berg; Jannes Michel; Antonius W. M. Mols, all of Eindhoven, Netherlands

[73] Assignee: U.S. Philips Corporation, New York, N.Y.

[21] Appl. No.: 350,858

[22] Filed: Dec. 7, 1994

[30] Foreign Application Priority Data

Dec. 7, 1993 [BE] Belgium ..... 09301346

[51] Int. Cl.[6] ..... H01F 3/06

[52] U.S. Cl. ..... 242/437.3; 242/439.5; 242/441.2; 29/605

[58] Field of Search ..... 242/437.3, 439.5, 242/441.2; 29/605

[56] References Cited

U.S. PATENT DOCUMENTS

| | | | |
|---|---|---|---|
| 3,855,694 | 12/1974 | Van Der Heijde | 242/437.3 |
| 4,007,881 | 2/1977 | Haslau et al. | 242/439.5 |
| 4,763,848 | 8/1988 | Bernhard | 242/437.3 |
| 4,937,931 | 7/1990 | Jacobs et al. | 9/605 |
| 5,265,814 | 11/1993 | Stralka | 242/439.5 |
| 5,340,044 | 8/1994 | Doomernik et al. | 242/437.3 |
| 5,355,578 | 10/1994 | Van Den Berg et al. | 29/605 |

FOREIGN PATENT DOCUMENTS

| | | |
|---|---|---|
| 0436998 | 7/1991 | European Pat. Off. . |
| 0572192 | 12/1993 | European Pat. Off. . |

*Primary Examiner*—Katherine Matecki
*Attorney, Agent, or Firm*—Robert J. Kraus

[57] ABSTRACT

Saddle-shaped, flared deflection coil for display tubes, having two arcuate connection portions at the ends and two interposed coil flanks located at both sides of a window. The coil is wound by making use of two wire bundles which are simultaneously fed (by means of two winding arms or flyers). At certain instants during the winding process, the flyers can be moved apart in such a way that a pin can be inserted between the wire bundles. The result is a coil having (triangular) apertures in the flank portions in which one wire bundle extends along one side of each aperture and the other wire bundle extends along another side.

6 Claims, 3 Drawing Sheets

METHOD OF WINDING A SADDLE-SHAPED DEFLECTION COIL

BACKGROUND OF THE INVENTION

The invention relates to a saddle-shaped deflection coil which flares out from a rear end towards a front end and is of the type having an arcuate connection portion at the front end, an arcuate portion at the rear end, and two interposed coil flanks longitudinally extending at both sides of a window. A customary method of manufacturing such a coil comprises the steps of:

a. providing a jig having a recessed winding space formed between two jig sections, which space has a shape which corresponds to the desired shape of the coil, for taking up continuously fed winding wire; and b. continuously feeding winding wire to the recess for forming a plurality of coil turns. Generally, the longitudinal turns of the coil are spread over a plurality of sections, each turn of a section surrounding the turns of the previous sections and each pair of adjacent sections being separated over a part of its length by at least one aperture which is formed in that a pin is inserted into the winding space at at least two locations at both sides of the coil window along the boundary between the two sections after the number of turns desired for the first of these two sections has been provided, whereafter the second section is wound around these pins.

It is conventional practice to combine a set of saddle-shaped line deflection coils with a set of saddle-shaped field deflection coils or a set of field deflection coils toroidally wound on a core to form an electromagnetic deflection unit. The nominal design of the coils may be such that, for example, certain requirements with respect to the geometry of a raster scanned by means of the deflection unit on the display screen of a display tube and/or with respect to the convergence of the electron beams on the display screen are satisfied.

In the above-mentioned method, the properties of the coil may be influenced by determining the location of the open spaces during design and choosing the number of turns per section during winding. In many cases this provides the possibility of adapting the wire distribution and hence the distribution of the magnetic flux generated by the coil to the imposed requirements. It has recently become desirable to wind saddle coils with a plurality of (parallel) wires simultaneously (referred to as multiwire winding) instead of with one wire. In this way deflection coils are obtained which can be used at higher (line) frequencies. For use at (line) frequencies of 32 kHz or more, the copper resistance must be decreased while maintaining the number of turns. This means that a plurality of wires must be wound (and parallel arranged) simultaneously (for example, in bundles of 4, 8 or 16 wires), so that each turn comprises a plurality of simultaneously wound wires.

SUMMARY OF THE INVENTION

According to the invention, a saddle-shaped coil of the type described in the opening paragraph, in which the longitudinal turns of the coil are spread over a plurality of sections and in which each turn of a section surrounds the turns of the previous sections and each pair of adjacent sections is separated over a part of its length by at least one aperture is therefore characterized in that each turn comprises a plurality of simultaneously wound wires.

However, now it appears to be much more difficult to realise a nominal design which satisfies the requirements imposed on, for example raster performance and/or convergence performance.

In conventional TV receiver sets, or in monitor sets, a raster is formed by causing an electron beam to scan the face plate of the display tube. The (geometrical) raster errors which may occur are north-south raster errors (errors at the lower and upper side of the raster) and east-west raster errors (errors at the left and the right side of the raster). In colour display tubes having an "in-line" arrangement of the electron guns, the east-west raster error becomes manifest as a pincushion or barrel distortion of the left and right boundaries of the raster scanned on the display screen.

It is a particular object of the invention to provide the designer of a multiwire-wound coil with an extra facility to influence the distribution of the magnetic flux generated by the coil.

To this end, the deflection coil according to the invention is characterized in that the wires of at least one turn are split into at least two bundles which extend along different sides of an aperture at two locations at both sides of the window.

The invention is suitable for use in (winding) line deflection coils and field deflection coils.

In a method of manufacturing a saddle-shaped coil in the manner described hereinbefore, a plurality of wires is continuously fed simultaneously in the form of a bundle to the winding space (winding gap).

If, in accordance with a further aspect of the invention, a plurality of winding arms (also referred to as flyers) is used for simultaneously feeding a corresponding plurality of sub-bundles of wire to the winding space, it appears that a more accurate location of the wires in the coil flanks is obtained (less scrambled twists, fewer spread errors).

The use of more than one winding arm particularly yields an advantage when projections must be inserted into the winding space at predetermined locations when the coil is being wound.

One part of the total wire bundle may then be fed along one side of the projection and another part of the bundle may be fed along the other side of the projection. In this way, only a part of the total wire bundle instead of the entire wire bundle is "displaced". By displacing only a part of the wire bundle it is achieved that the coil designer will have a greater freedom in the nominal design of the coil. Moreover, asymmetries can be corrected.

These and other aspects of the invention will be apparent from and elucidated with reference to the embodiments described hereinafter.

DETAILED DESCRIPTION OF THE PREFERRED EMBODIMENTS

Figure 1:
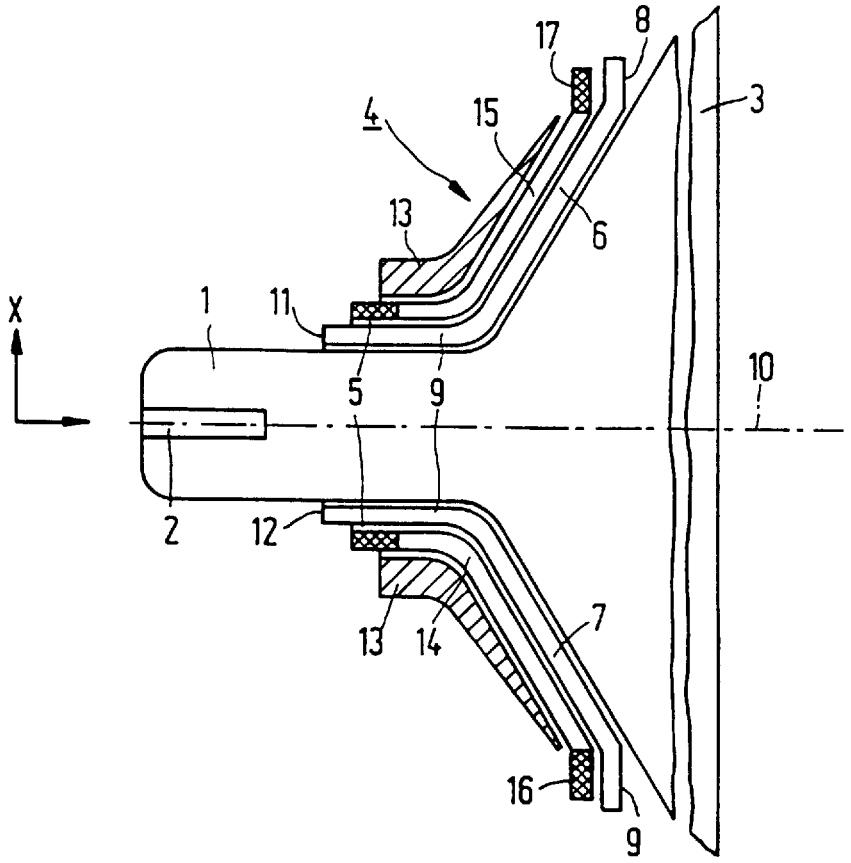
FIG. 1 PRIOR ART
FIG. 1 is a diagrammatic longitudinal section of a portion of a picture display tube including a deflection unit.

FIG. 1 shows a colour display tube 1 comprising an electron gun system 2 for generating three electron beams directed towards a display screen 3 having a repetitive pattern of red, green and blue phosphor elements. An electromagnetic deflection system 4 is arranged coaxially with the axis of the tube around the path of the electron beams between the electron gun system 2 and the display screen 3. The deflection system 4 has a funnel-shaped synthetic material coil support 5 whose inner side supports a line deflection coil system 6, 7 for deflecting the electron beams generated by the electron gun system 3 in a horizontal direction. The flared line deflection coils 6, 7 are of the saddle type and have a front flange 8, 9 at their widest end, which flange is substantially located in a plane at an angle to the axis 10 of the display tube. At their narrowest end, the coils 6, 7 have packets of connection wires 11, 12 which connect the longitudinal flank portions of each coil 6, 7 to each other and are laid across the surface of the display tube 1. The coils 6, 7 are thus of the type having a "lying" rear flange and an "upstanding" front flange in the case shown. Alternatively, they may be of the type having an "upstanding" rear flange and an "upstanding" front flange, or of the type having a "lying" rear flange and a "lying" front flange.

At its outer side, the coil support 5 supports two saddle-shaped field deflection coils 14, 15 for deflecting electron beams generated by the electron gun system 3 in a vertical direction. A ferromagnetic annular core 13 surrounds the two sets of coils. In the case shown the field deflection coils are of the type having an upstanding front flange 16, 17 and a lying rear flange. Alternatively, they may be of the type having an upstanding rear flange and an upstanding front flange, or of the type having a lying rear flange and a lying front flange.

Figure 2:
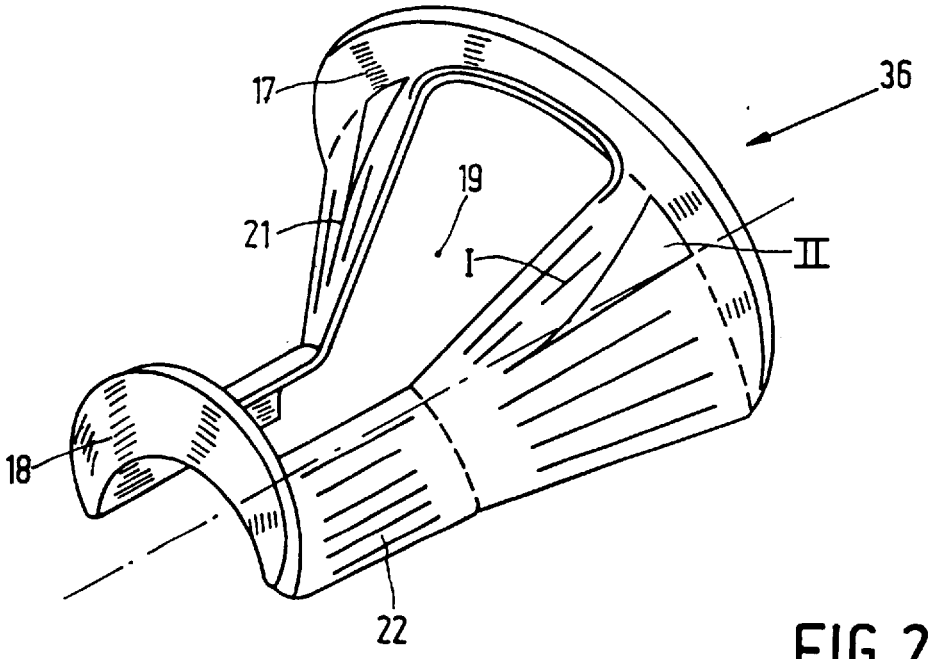
FIG. 2 PRIOR ART
FIG. 2 is a perspective elevational view of a conventional saddle-shaped deflection coil.

FIG. 2 shows a conventional line deflection coil 6 in a perspective elevational view. This coil comprises a plurality of turns of, for example copper wire and has a rear end portion 18 and a front end portion 17 between which two flank portions 21, 22 extend at both sides of a window 19. As is shown in the Figure, the front end portion 17 and the rear end portion 18 are bent "upwards". This need not always be the case with the rear end portion 18. It is obvious that bending one or both end portions upwards or not upwards is a design parameter which is irrelevant to the measures according to the invention. All these possible embodiments are summarized under the term "saddle-shaped deflection coils". The coil 6 flares out from the rear to the front so that it is adapted to the funnel shape of the portion 5 of the picture display tube.

Figure 3:
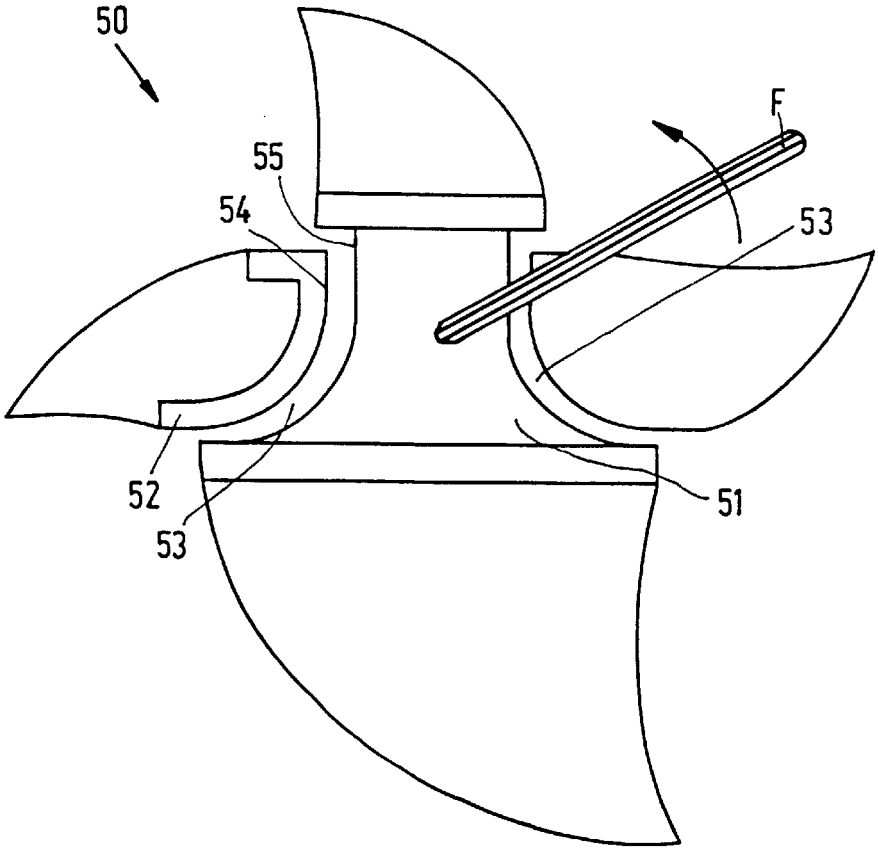
FIG. 3 is a diagrammatic cross-section of a winding unit with 1 flyer which can be used for winding saddle coils.

The magnetic flux required for deflecting electron beams is substantially entirely generated in the flank portions 21, 22. The flux generated in the end portions 18 and 17 substantially does not contribute to the deflection. Each of the flank portions 21, 22 may have a number of apertures in the widening (flared) portion but also in the cylindrical (neck) portion for forming a number of sections. As is shown in the Figure, the deflection coil shown by way of example is divided into a first section I and a second section II in the flared portion. Each turn of the second section surrounds the turns of the first section which is located further inwards (closer to the window 19). By choosing the number, the location and the shape of the apertures near the front end, as well as the number of turns in each section I, II a designer can influence the nominal distribution of the magnetic flux generated in the active portions 21, 22. The invention itself will now be described with reference to FIGS. 3, 4 and 5. FIG. 3 is a diagrammatic elevational view of a winding unit used in the winding process. This winding process is carried out in a recess (winding space) 53 provided in the jig 50 which is shown in FIG. 3 and forms part of a winding machine. To simplify the Figure, the winding machine is not shown in detail. The jig 50 has two sections 51 and 52 between which the winding space 53 is recessed which is bounded by walls 54, 55 whose shape corresponds to the outer boundaries of the coil to be wound.

This winding machine winds a deflection coil in a stationary jig by means of one winding arm F (flyer) through which the wire is guided. During this winding process, pins are inserted into the jig at a number of locations, so that apertures are produced in the coil body.

If the design of a coil is found to be unsatisfactory, the following correction method will be applied. The pin is inserted one revolution earlier or later, so that a bundle of wire is shifted and the magnetic field is changed.

When coils are used for a line frequency which is higher than 32 kHz, the copper resistance must be decreased while maintaining the number of turns, i.e. a plurality of wires "in parallel". Now, correction will be more difficult. This is ascribed to the fact that a large number of wires (wire bundle) is shifted in one operation. Shifting such a complete bundle might have too much effect on, for example the convergence.

If the machine is implemented with two flyers (FIG. 5), a part of the bundle can be displaced, because the complete bundle of wires has been split up into two (equal or unequal) sub-bundles and one sub-bundle can be displaced, whereas the other cannot. Both flyers rotate at the same speed and into the same direction with an angular deviation of 0°. If a pin is to be inserted between the two sub-bundles, the number of revolutions will decrease considerably and one flyer will have an angular deviation of approximately 90° with respect to the other, and when the pin is inserted, the angular deviation will be 0° again and the number of revolutions increases to the nominal number again. If a pin is not inserted between the bundles (both bundles are displaced), then this is effected in the normal manner.

If desired, it is alternatively possible to work with 3 flyers.

Figures 4A, 4B, 4C:
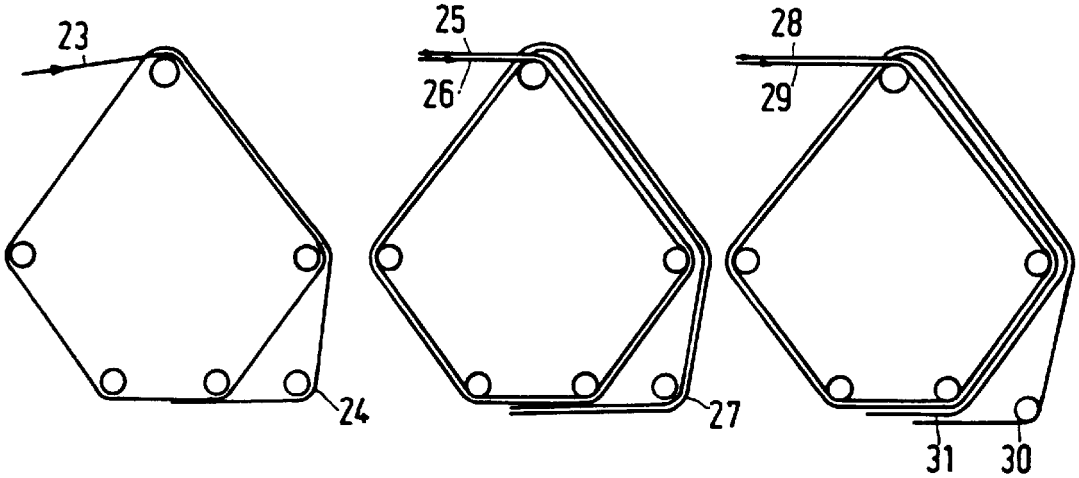
FIGS. 4A, 4B and 4C are winding schemes for winding with one wire bundle, two wire bundles and two split wire bundles, respectively.

This will be elucidated with reference to FIGS. 4A, 4B, and 4C.

FIG. 4A illustrates the conventional winding method using one flyer and one wire bundle 23. After pin 24 has been introduced into the winding space, a subsequent wire packet is wound. The number of wires in such a packet is equal to the number of wires in the wire bundle 23 multiplied by the number of turns. The pins may be inserted at a number of different longitudinal positions (different Z levels).

FIGS. 4B and 4C illustrate the winding method using two flyers and two wire sub-bundles 25, 26, one wire sub-bundle per flyer. Normally, both flyers are equally directed. The distance between the two flyers is small. The wire spread of the two wire sub-bundles can be freely chosen.

In the situation shown in FIG. 4B the two flyers retain their equal directions and the winding operation may be carried out at a high number of revolutions, also when pin 27 is inserted.

In the situation shown in FIG. 4C, pin 30 is inserted between the wire subbundles 28 and 29. To this end, the number of revolutions of the flyers is temporarily decreased and they are moved away from each other (until an angular difference of approximately 90° is obtained). During this operation sub-bundle 29 is laid around the (old) pin 31 and sub-bundle 28 is laid around the (new) pin 30. By splitting the wire bundle into two sub-bundles, it is possible to realise a "controlled" displacement in this way.

The use of two (or more) flyers is not without any problem. The simplest solution would be to place a second flyer on the same shaft as the first flyer. However, stationary wire feeders feed the wires to the flyer via a non-rotating lead-through duct. As long as one flyer is secured to this system, nothing special happens. In fact, the various wires are twisted and fed to the winding jig via the flyer wheels. If a second flyer is placed on the same shaft, the wires will be twisted and subsequently drawn apart because one half must be guided via the left-hand set of wheels and the other half must be guided via the right-hand set of wheels of the double flyer. This may involve the risk that the wires are torn and the coil is not finished.

If the second flyer is placed on a second shaft, which is located at a small distance next to the first shaft, this system can process the wires, but then there is another problem. The two flyers should rotate at the same number of revolutions and into the same direction. This is possible as long as the mutual angle is not too large. At an angular deviation of 7° the flyers will touch each other, either at the upper side or at the lower side. This deviation is too small to insert pins between the wires. To solve this problem, the number of revolutions just before and during insertion of a pin is decreased from several hundred revolutions per minute to 10 to 20 revolutions per minute. If the set of flyers has approached the pin position up to a certain distance, the angle of the flyers is increased to 90°, the pin is inserted and the angle is decreased to 0° again. Subsequently the number of revolutions can be raised again.

Each flyer may carry an equally large number of wires, for example 4 or 8 each, or different numbers of wires, for example one flyer may carry three wires and the other may carry four, or one flyer may carry four wires and the other may carry six, and so forth.

Single wires may be used. However, alternatively, multiple wires of the parallel or twisted litze type may be used.

Figure 5:
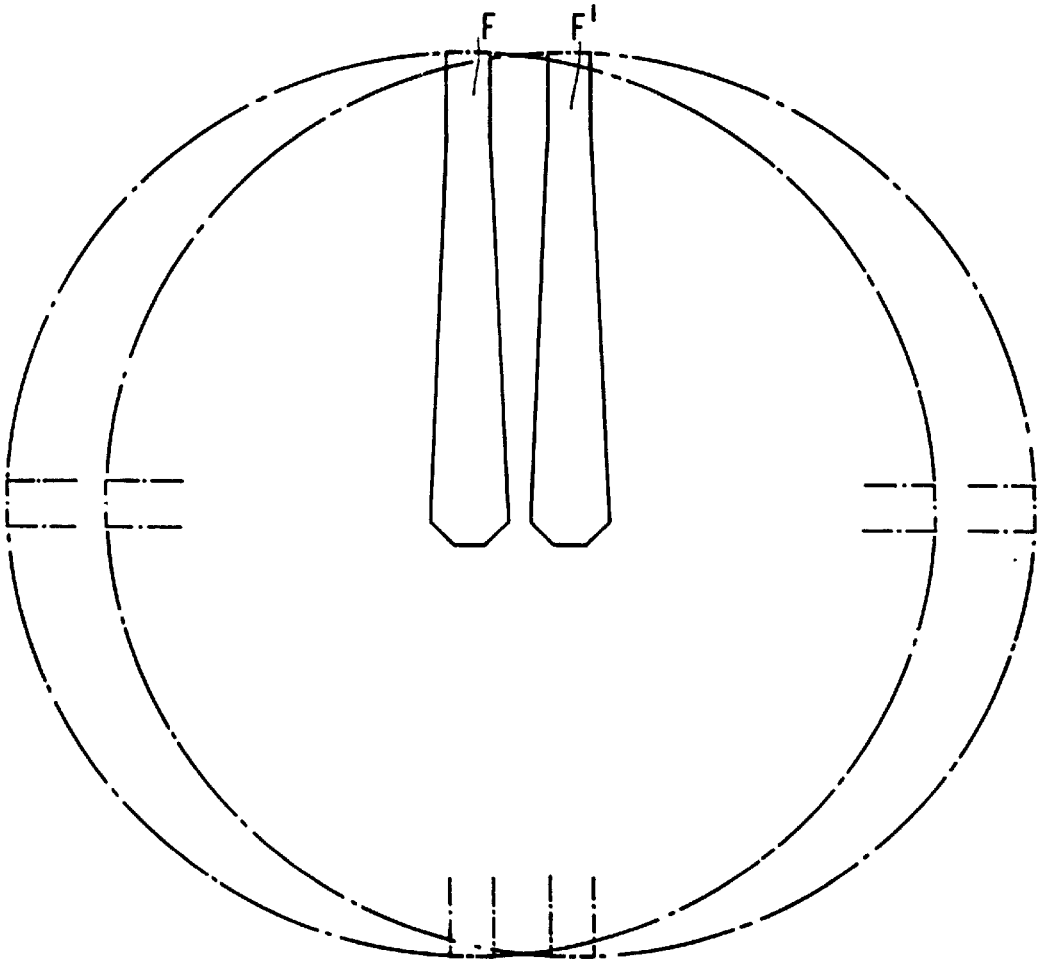
FIG. 5 is a front elevational view of a winding unit with 2 flyers F and F'.

FIG. 5 is a front elevational view of a winding unit with two flyers F and F' arranged right next to each other on two shafts. Both flyers have the same direction of rotation. Their mutual positions are shown once per 90°.

In summary, the invention thus provides a saddle-shaped, flared deflection coil for display tubes, having two arcuate connection portions at the ends and two interposed coil flanks at both sides of a window. Two wire bundles simultaneously fed (by means of two flyers) are used for winding the coil. At given instants during the winding operation, the winding arms may be moved away from each other so that a pin can be inserted between the wire bundles. The result is a coil having (triangular) apertures in the flank portions in which one wire bundle extends along one side of each aperture and the other wire bundle extends along another side.

We claim:

1. A method of manufacturing a saddle-shaped deflection coil which flares out from a rear end towards a front end and has an arcuate connection portion at the front end, an arcuate connection portion at the rear end and two interposed coil flanks longitudinally extending at both sides of a window, comprising the steps of:

a. providing a jig having a recessed winding space formed between two jig sections, which space has a shape which corresponds to the desired shape of the coil, for taking up continuously fed winding wire; and b. continuously feeding a plurality of wires in a bundle to the recessed winding space for forming a plurality of coil turns in the winding space by means of a plurality of winding arms, thereby simultaneously feeding the wires to the winding space as a plurality of sub-bundles corresponding to respective said winding arms.

2. A method of manufacturing a saddle-shaped deflection coil which flares out from a rear end towards a front end and has an arcuate connection portion at the front end, an arcuate connection portion at the rear end and two interposed coil flanks longitudinally extending at both sides of a window, comprising the steps of:

a. providing a jig having a recessed winding space formed between two jig sections, which space has a shape which corresponds to the desired shape of the coil, for taking up continuously fed winding wire; and b. continuously feeding a plurality of wires in a bundle to the recessed winding space for forming a plurality of coil turns in the winding space c. inserting, during step b, a projection into the winding space at a predetermined location in each portion where a coil flank is formed, after a predetermined plurality of coil turns has been formed, d. after a projection has been inserted, during step b, guiding one part of the bundle along one side of the projection and guiding another part of the bundle along the other side of the projection.

3. A method as claimed in claim 2 wherein a separate rotating winding arm is used for feeding winding wire for each part of the bundle.

4. A method as claimed in claim 3 wherein the winding arms rotate with a first angular distance therebetween except when a projection is inserted, at which time the arms rotate with a second angular distance therebetween which is larger than said first angular distance.

5. A method as claimed in claim 4 wherein the winding arms rotate at a first speed of rotation except when a projection is inserted, at which time they rotate at a second speed of rotation which is slower than said first speed.

6. A method as claimed in claim 3 wherein the winding arms are mounted eccentrically with respect to a common axis of rotation.

* * * * *